US005383240A

United States Patent [19]

Weeks, Sr.

[11] Patent Number: 5,383,240

[45] Date of Patent: Jan. 24, 1995

[54] ADJUSTABLE TRIM STRIPS FOR BATHROOM FIXTURES

[76] Inventor: Alton S. Weeks, Sr., 686 Anderson Dr., Jonesboro, Ga. 30236

[21] Appl. No.: 191,079

[22] Filed: Feb. 4, 1994

[51] Int. Cl.[6] ..... A47K 3/02

[52] U.S. Cl. ..... 4/584

[58] Field of Search ..... 4/538, 584, 592, 593

[56] References Cited

U.S. PATENT DOCUMENTS

| | | | |
|---|---|---|---|
| 2,267,513 | 12/1941 | Waterman | 52/35 |
| 2,407,738 | 9/1946 | Falco | 4/584 |
| 2,526,883 | 10/1950 | Barre | 52/35 |
| 2,919,449 | 1/1960 | Bowden | 4/584 |
| 3,028,603 | 4/1962 | Rodman | 4/559 |
| 3,283,340 | 11/1966 | McMurtrie et al. | 4/584 |
| 3,299,444 | 1/1967 | Gangelhoff | 4/584 X |
| 4,669,133 | 6/1987 | Blecher et al. | 4/538 |
| 5,208,924 | 5/1993 | Smith et al. | 4/584 |

FOREIGN PATENT DOCUMENTS

| | | | |
|---|---|---|---|
| 0241063 | 7/1965 | Austria | 4/584 |
| 0568363 | 12/1958 | Canada . | |
| 3525187 | 1/1987 | Germany | 4/584 |
| 3907804 | 6/1990 | Germany | 4/584 |
| 0562587 | 7/1944 | United Kingdom | 4/593 |

*Primary Examiner*—Robert M. Fetsuga

*Attorney, Agent, or Firm*—Dowell & Dowell

[57] ABSTRACT

Bathtub and shower fixtures having a front wall which terminates in spaced relationship to a floor covering and an intermediate wall spaced between the front wall and a basin of the fixture. A vertically adjustable trim strip is selectively mounted to the intermediate wall so as to be engagable with the floor covering inwardly of the front wall thereby preventing water dripping from the front wall from entering a construction joint formed between the intermediate wall and the floor covering.

5 Claims, 2 Drawing Sheets

Fig. 1
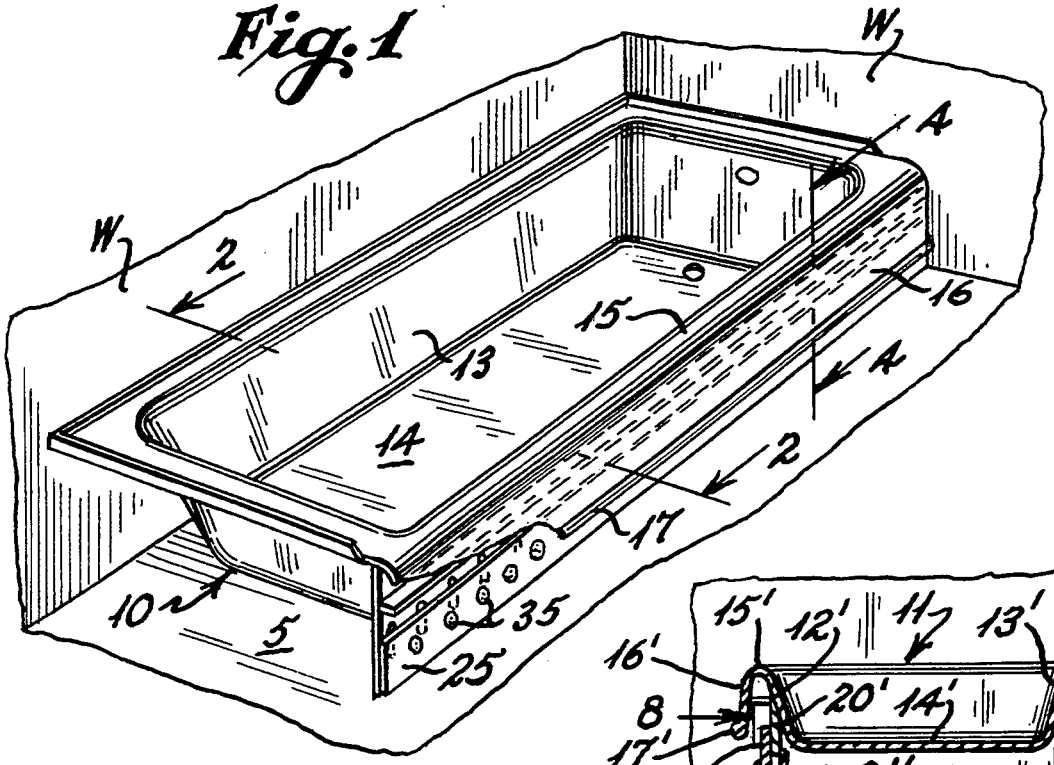
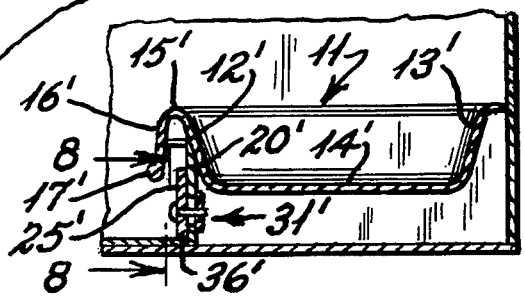
Fig. 7
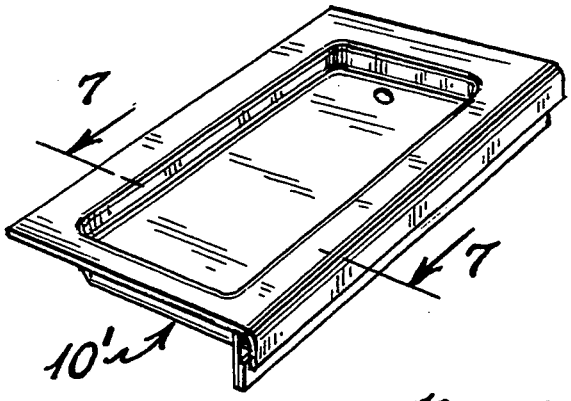
Fig. 6
Fig. 8
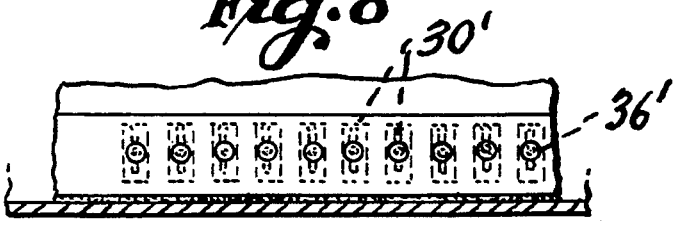

Fig.2
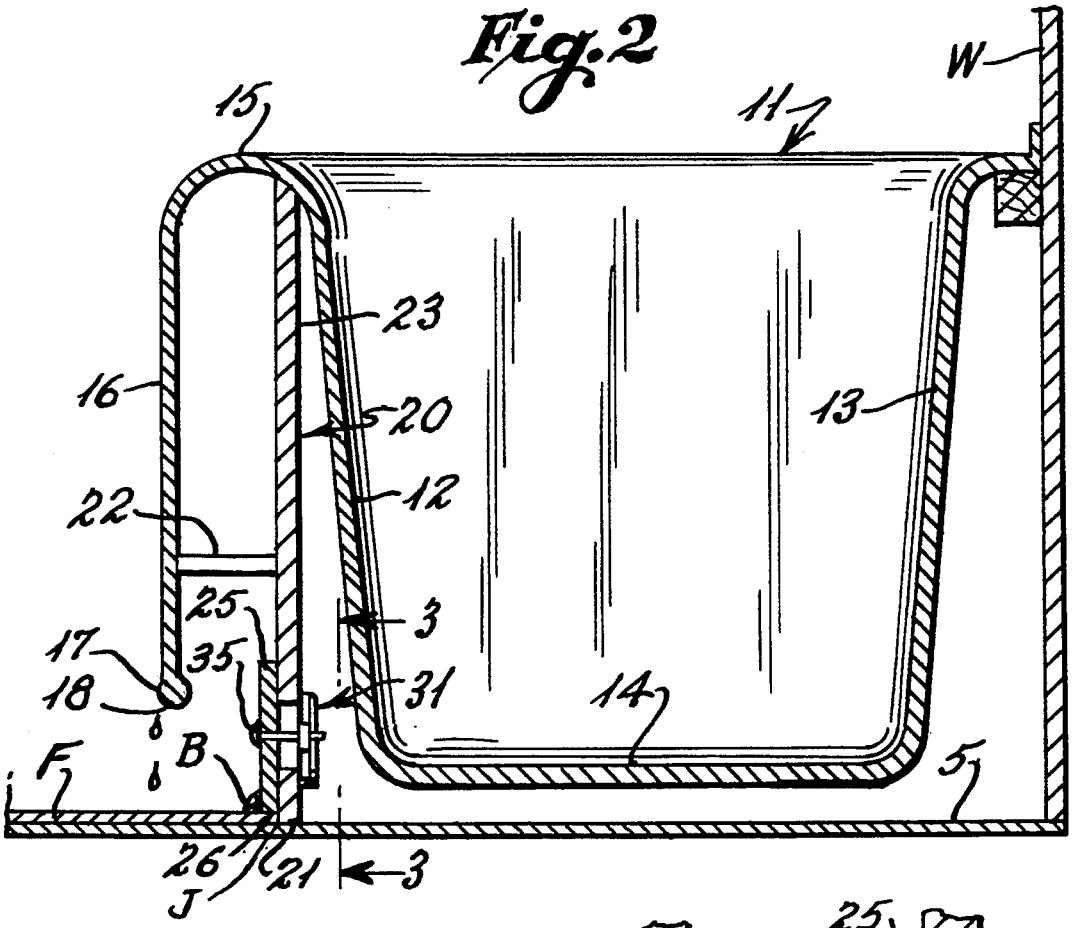
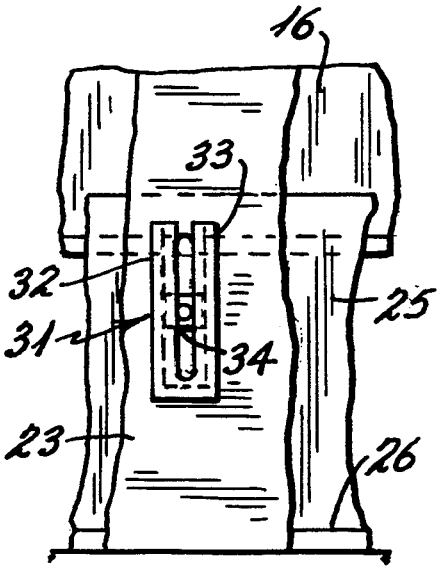
Fig.3
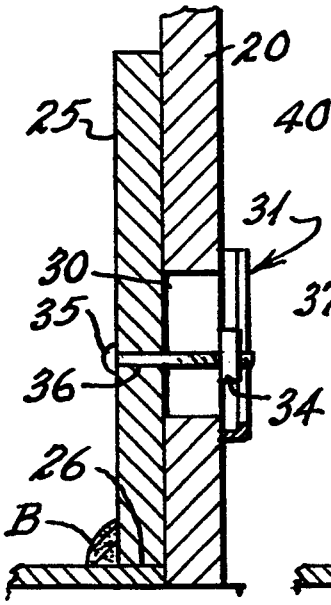
Fig.4
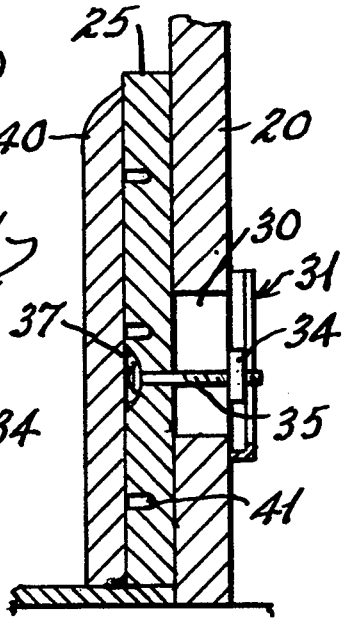
Fig.5

ADJUSTABLE TRIM STRIPS FOR BATHROOM FIXTURES

BACKGROUND OF THE INVENTION

1. Field of the Invention

This invention is generally directed to bathtub and shower fixtures of the type utilized in residential housing and more particularly to such fixtures which are provided with adjustable trim strips for preventing the penetration of water into a joint formed between the fixtures and a floor covering. More specifically, the present invention is directed to either bathroom or shower fixtures which have an outer front wall which is spaced from the basin of the fixture in such a manner that any water dripping from the front wall is deposited on a floor covering in spaced relationship from an intermediate wall which is positioned adjacent a joint with a floor covering such as a vinyl or ceramic tile material. The trim strip is positionable so as to abut the floor covering adjacent the joint between the flooring and the intermediate wall of the fixture.

2. History of the Related Art

One of the most intensive maintenance problems associated with residential and commercial housing or residences is related to repairing or maintaining areas associated with bathroom fixtures and especially bathtub and shower enclosures. This is because, in use, these fixtures cause a great deal of water to be deposited on the flooring adjacent to the fixture. This is true even where shower curtains and slidable or closable shower doors are used to limit the amount of moisture that is deposited on the adjacent floor covering.

As a result, the joints between such fixtures and the flooring are continuously exposed to dripping water. Over a period of time, the water penetrates caulked joints which are normally provided at the junction between the front wall of the fixture and the floor covering. Once a caulked joint begins to recede or crack, the water easily penetrates to the flooring and subflooring causing deterioration of the flooring and subflooring. In many instances, such leakage causes damage to lower levels of a dwelling such as a ceiling beneath the fixture in question.

In an effort to overcome the problems inherent with bathtub fixtures including bathtubs and showers, there have been many innovations developed for preventing water from penetrating the construction joints between the base of the fixtures and the flooring. In U.S. Pat. No. 2,267,513 to Waterman a cove base for use with bathtub and shower fixtures is disclosed wherein the outer wall of the fixture is spaced outwardly from the basin of the fixture to thereby create a drip line which is spaced from the joint of the fixture with the flooring. To prevent moisture from entering at the joint, in one embodiment, the patent discloses using a linoleum floor covering which is actually installed so as to curve vertically adjacent the wall of the fixture basin spaced inwardly from the front wall. The curved portion of the floor covering is supported by a suitable molding. In an alternative embodiment, where tile is used in place of linoleum, a separate cove tile which is generally L-shaped is installed against a reinforced block which abuts the basin inwardly of the front wall of the fixture. In the first embodiment, the floor covering must be installed to the base and then vertically upwardly relative to the basin of the tub. In the second embodiment, a joint which may be penetrated by water is created between the normal floor tile and the cove tile installed at the base of the fixture basin.

In U.S. Pat. No. 2,526,883 to LaBarre a seal for the base of a bathroom fixture is disclosed which includes a generally L-shaped intermediate wall portion which extends inwardly with respect to the front wall of the fixture. The front wall includes a lower edge which terminates in spaced relationship to the subflooring to which the fixture is secured. To prevent penetration of any water at the construction joint, an L-shaped flashing material is secured over the intermediate portion and extends upwardly above the lower edge of the front wall of the fixture. Thereafter a finished flooring and linoleum tile are spaced between the flashing and the lower edge of the front wall. Unfortunately, liquid may still drip down the front wall indirectly between the linoleum and the lower edge of the front wall and penetrate into the area of the interface between the finished flooring and the intermediate wall of the fixture. In addition, there is no way to adjust the vertical relationship of the components and, therefore, if different types of floor coverings are utilized, the fixture would not function properly to prevent liquid penetration at the construction joint.

Another bathtub fixture is disclosed in U.S. Pat. No. 2,919,449 to Bowden. The Bowden structure includes a removable front wall panel which when positioned in place is secured by utilizing a molding strip at the base between the panel and the subflooring. Again, there is no structure disclosed for providing any vertical adjustment of the front wall relative to the flooring so as allow for different types of floor coverings to be utilized so that the joint between the covering and the flooring or subflooring is protected from moisture penetration.

In U.S. Pat. No. 3,028,603 to Rodman a disclosure is made of a fixture incorporating a removal front apron panel which is secured at its lower edge by a bracket which is mounted to the floor covering. With this structure, the bracket must be secured to the floor covering and provides support for the front apron, however, any load placed on the front apron must be transferred through a clip member which is vertically adjustably secured to the mounting bracket. In view of the foregoing, the structure can not allow the bracket to be adjusted relative to the flooring. In addition, all the load from the upper ledge of the tub is transmitted through the connection joint between the apron and the bracket at a point where only horizontal connections are made between the two elements. This structure limits the amount of load which may be satisfactorily supported along the front ledge of the fixture.

U.S. Pat. No. 4,669,133 to Blecher et al., discloses an apron for bathroom fixtures which includes a foamable material which is introduced into an apron assembly and is expanded in situ so as to form a seal along the upper and lower edges thereof. U.S. Pat. No. 5,208,924 to Smith et al. discloses a decorative front assembly for use with bathtubs and related bathroom fixtures. Additional examples of related prior art are disclosed in Canadian Patent 568,363 dated Dec. 30, 1958, U.S. Pat. No. 2,407,738 to Falco and U.S. Pat. No. 3,283,340 to McMurtrie et al.

SUMMARY OF THE INVENTION

This invention is directed to a bathroom fixture such as a bathtub or shower which includes a basin having opposing inner walls and a front wall which depends and has a lower edge which terminates in spaced relationship with respect to a floor covering. The fixture also includes an intermediate wall between the basin and the front wall to which an elongated trim strip is vertically adjustably mounted. The trim strip is designed to be engagable with the floor covering with the floor covering abutting against the intermediate wall. The trim strip extends generally below the lower edge of the front wall. In the preferred embodiment, the lower edge of the front wall is beaded so as to form a surface to promote discharge or dripping of water outwardly with respect to the trim strip along the surface of the floor covering.

In some embodiments, a separate molding may be attached to the trim strip so that the fixture base is complementary to the molding used in the rest of the room in which the fixture is placed.

A BRIEF DESCRIPTION OF THE DRAWINGS

FIG. 1 is a perspective view of one embodiment of the present invention in the form of a bathtub having portions broken away to show the vertically adjustable trim strip.

FIG. 2 is an enlarged cross-sectional view taken along line 2—2 of FIG. 1.

FIG. 3 is an enlarged partial cross-sectional view having portions broken away showing a vertical slot and caged nut utilized to adjust the trim strip of the present invention.

FIG. 4 is an enlarged cross-sectional view taken along line 4—4 of FIG. 1.

FIG. 5 is a cross-sectional view similar to that of FIG. 4 except showing an additional molding strip secured to the trim strip taken along the line 4—4 of FIG. 1.

FIG. 6 is a perspective view of a second embodiment of the present invention showing the invention in the configuration of a shower fixture.

FIG. 7 is a cross-sectional view taken along line 7—7 of FIG. 6.

FIG. 8 is a partial cross-sectional view taken along line 8—8 of FIG. 7.

DESCRIPTION OF THE PREFERRED EMBODIMENT

With continued reference to the drawings, a bathtub fixture 10 is shown as being installed between the walls "W" and subflooring "S" of a structure. The fixture is constructed and designed to prevent water from penetrating from the tub to an area of the joint between the tub and the flooring or subflooring so as to prevent deterioration of the flooring and subflooring by moisture. In this respect, the tub includes a basin 11 defined by opposing sidewalls 12 and 13 and a lower wall 14 which is shown as being spaced from the flooring "S". The bathtub includes a front ledge 15 from which depends a front wall 16 having a lower wall 17 which terminates in spaced relationship with respect to a floor covering "F" which covers the flooring "S". As shown in FIG. 2, the lower edge 17 is rounded as shown at 18 so as to promote moisture to form droplets and drip from the lower edge 17 of the front wall 16 to the floor covering "F" in spaced relationship from a joint "J" between the floor covering and the flooring "S".

As shown in drawing FIGS. 2–5, the bathtub fixture also includes an intermediate depending wall 20 having a lower edge 21 which abuts the flooring "S" adjacent to the joint "J" between the floor covering and the flooring so that the floor covering actually abuts the surface of the intermediate wall at the joint. The front wall 16 may be reinforced by an elongated spacer 22 which extends between the front wall 16 and the intermediate wall 20. Although the intermediate wall 20 is shown as extending from the ledge 15 to the flooring "S", it should be noted that in some embodiments, the intermediate wall may extend from a point below the ledge 15 and may be directly connected to either the front wall 16 or the sidewall 12 of the basin 11. Due to the front wall construction any moisture which is splashed over the ledge 15 which would drip down the front wall 16 will be deposited on the floor covering "F" at a point spaced from the construction joint "J".

In order to allow for the installation of different types of floor coverings, such as ceramic tile, carpet, linoleum tile and the like, and in the event any reinforced subflooring is provided underneath the floor covering, a vertically adjustable trim strip 25 is provided which extends along the full length of the front wall 16 and the intermediate wall 20. As shown in drawing FIGS. 2–5, the lower edge 26 of the trim strip engages the floor covering "F". In order to provide further protection to prevent moisture from entering to the area of the construction joint "J", a caulking bead "B" may be applied between the floor covering and the trip strip after the trim strip is appropriately placed.

To allow the vertical positioning of the trim strip 25, a plurality of spaced vertical slots 30 are provided adjacent the lower edge 21 of the intermediate wall 20. Mounted on the rear surface 23 of the intermediate wall 20 in alignment with each of the slots 30 are cage assemblies 31. Each cage assembly includes opposing channels 32 and 33 which are spaced outwardly from the rear surface 23 so as to form tracks in which a square shaped nut 34 is slidable received. The clearance between the channels and the nut ensures that the nut can not be rotated between the channel members 32 and 33 but can be raised and lower vertically relative to the slot 30. Each nut 34 has a threaded opening for receiving the complementary threaded shank of a screw 35. The screws 35 extend through a plurality of spaced openings 36 provided in the trim strip 25 which are aligned with the vertical slots 30 through the intermediate wall. As shown, by loosening the screws 35 with respect to the caged nuts 34, the trim strip may be vertically raised or lowered as desired to permit installation or removal of the floor covering "F" after which the trim strip may be seated on a new floor covering and an appropriate bead of caulk applied at the joint therebetween.

The present invention may also be modified to allow the placement of a decorative base molding which correspond to the base molding used elsewhere in the room in which the fixture is installed. As shown in FIG. 5, the trim strip may be provided with a plurality of recesses 37 formed in countersunk relationship with the openings 36 so as to allow the heads of the screws to be seated therein. Afterward, a decorative base molding 40 may be secured to the trim strip by appropriate fasteners such as pins 41 which protrude from the rear of the base molding.

A second embodiment of fixture in accordance with the teachings of the present invention is shown in FIGS. 6–8. In this embodiment, the fixture is shown as being adapted for a shower. In this embodiment, the fixture 10' includes a basin 11' having opposing sidewalls 12' and 13' and lower wall 14'. Ledge 15' is provided along the front portion of the fixture and from which depends a front wall 16' having a lower edge 17' which is preferably beaded as discussed above with respect to the previous embodiment. It is noted that, in this embodiment, the base is much shallower than in the previous embodiment.

As with the previous embodiment, an adjustable trim strip 25' is mounted to an intermediate wall 20' utilizing a caged nut assembly 31'. Again, a plurality of openings 36' are provided through the trim strip which aligned with vertical slots 30' made through the intermediate wall 20'. As with the previous embodiment, a suitable base trim may be applied over the trim strip so that the bathroom trim corresponds to the remaining base molding of the bathroom area.

I claim:

1. A bathroom fixture for bathing or showering which is designed to be supported on a floor of a structure so as to form a seal with a floor covering, the fixture comprising, a generally U-shaped basin having opposing sidewalls and a bottom wall, a front wall connected to one of said sidewalls and depending vertically to a lower edge, an intermediate wall extending vertically between said front and said one of said sidewalls and having a substantially continuous lower edge extending below said lower edge of said front wall which lower edge of said intermediate wall is engageable with the floor, said intermediate wall having front and rear surfaces, and a plurality of horizontally spaced vertical slots in said intermediate wall adjacent said lower edge thereof, a trim strip extending along the length of said intermediate wall in covering relationship to said slots therein, said trim strips having a lower edge extending forwardly of said front surface of said intermediate wall, a plurality of horizontally spaced openings in said trim strip, and means extending through said openings in said trim strip and said slots in said intermediate wall for securing said trim strip in vertically adjustable relationship to said intermediate wall, whereby said trim strip may be selectively engaged with the floor covering at a point below said lower edge of said front wall and above said lower edge of said intermediate wall.

2. The bathroom fixture of claim 1 in which said lower edge of said front wall is rounded to form an elongated beaded surface to thereby promote the dripping of water therefrom.

3. The bathroom fixture of claim 1 including a plurality of cage assemblies mounted in horizontally spaced relationship to said rear surface of said intermediate wall, each of said cage assemblies including opposing channels adjacent each of said slots, said means for securing including a nut carried between each of said opposing channels and bolts extending through said openings in said trim strip and said slots and engageable with said nuts.

4. The bathroom fixture of claim 3 including a base molding member and fastener means for mounting said base molding member to said trim strip.

5. The bathroom fixture of claim 1 including a base molding member and fastener means for mounting said base molding member to said trim strip.

* * * * *